US007748544B1

(12) United States Patent
Davitz

(10) Patent No.: US 7,748,544 B1
(45) Date of Patent: Jul. 6, 2010

(54) RACK SYSTEM FOR HOME AND GARDEN

(75) Inventor: Daniel E. Davitz, Ashville, OH (US)

(73) Assignee: Production Plus Corp., Columbus, OH (US)

( * ) Notice: Subject to any disclaimer, the term of this patent is extended or adjusted under 35 U.S.C. 154(b) by 279 days.

(21) Appl. No.: 11/567,024

(22) Filed: Dec. 5, 2006

Related U.S. Application Data

(60) Provisional application No. 60/597,477, filed on Dec. 5, 2005.

(51) Int. Cl.
*A47F 7/00* (2006.01)

(52) U.S. Cl. ..... 211/70.6

(58) Field of Classification Search ..... 211/70.6, 211/118, 117, 13.1, 60.1, 119, 113; 204/297.06, 204/297.09; 118/500
See application file for complete search history.

(56) References Cited

U.S. PATENT DOCUMENTS 1,533,805 A * 4/1925 Oliver ..... 204/297.06
3,272,733 A * 9/1966 Linquist et al. ..... 204/297.1
3,357,913 A * 12/1967 Zavarella ..... 204/297.06
4,037,727 A * 7/1977 Kunkle ..... 211/117
4,097,359 A * 6/1978 Davitz ..... 204/297.06
4,217,853 A 8/1980 Davitz
4,243,146 A 1/1981 Davitz
4,424,908 A * 1/1984 Davitz ..... 211/118
4,872,963 A * 10/1989 Van Horn ..... 204/297.09
5,147,050 A * 9/1992 Cullen ..... 211/118
5,412,912 A * 5/1995 Alves ..... 52/36.5
5,531,334 A * 7/1996 Forby ..... 211/119
5,762,205 A * 6/1998 Davitz ..... 211/13.1
5,875,901 A * 3/1999 Morrow et al. ..... 211/59.1
5,897,002 A * 4/1999 Carlino ..... 211/70.6
5,897,709 A * 4/1999 Torefors ..... 118/500
5,908,120 A * 6/1999 Yates et al. ..... 211/119
6,311,854 B1 * 11/2001 Anderson ..... 211/70.6
6,530,489 B1 * 3/2003 Van Horn et al. ..... 211/113
6,571,968 B1 * 6/2003 Cullen ..... 211/113
6,969,036 B2 * 11/2005 Magnusson ..... 248/339
7,021,476 B2 * 4/2006 Lloyd et al. ..... 211/113

* cited by examiner

*Primary Examiner*—Sarah Purol
(74) *Attorney, Agent, or Firm*—Hahn Loeser & Parks, LLP; Rex W. Miller, II

(57) ABSTRACT

A wall organization rack with detachable, convertible hooks that may be used in garages, utility rooms, shops, retail establishments, residential basements, sheds, etc. The system comprises a horizontal crossbar support rack member and a plurality of different support hooks that engage a variety of objects. The support hooks comprise a specialized attachment end that allows the user to attach and remove the support hook from the crossbar by hand quickly and efficiently without the use of special tools. When attached, the support hook can withstand a substantial downward force. The user can change the support hooks as desired in order to space the hooks to efficiently accommodate each particular tool or group of tools, such as when new tools are purchased or replaced or stored during different seasons.

17 Claims, 8 Drawing Sheets

RACK SYSTEM FOR HOME AND GARDEN

The present application claims the benefit of U.S. Provisional Patent Application Ser. No. 60/597,477, filed Dec. 5, 2005, herein incorporated by reference.

TECHNICAL FIELD

This invention relates generally to a wall organization rack and more particularly to a metal support rack with detachable, convertible hooks that may be used in garages, utility rooms, shops, retail establishments, residential basements, sheds, etc. The system comprises a horizontal crossbar support rack member and a plurality of different support hooks that engage a variety of objects.

BACKGROUND OF THE INVENTION

Wall racks for the storage and organization of household and garden tools have long existed in the prior art. Where various tool sizes, shapes and weights are desired to be hung on a wall mounted tool rack, it is desirable to have a plurality of hooks available wherein the various tools of differing sizes and shapes can be properly supported. It is further desirable to organize their storage in a manner which promotes an economy of storage space. Current prior art wall racks are limited as they typically provide only a limited style of hooks and the hooks are typically permanent or difficult to remove and replace, often requiring the use of hand tools.

SUMMARY OF THE INVENTION

The present invention overcomes at least one of the limitations identified in the prior art by providing a support rack comprising a crossbar comprising spaced, generally parallel, wall portions, the wall portions being attached to each other at least by a plurality of crossbeams extending between the wall portions, the crossbeams being spaced along the length of the wall portions; and a plurality of support hooks, each support hook comprises a workpiece engaging portion and a crossbar engaging portion; the crossbar engaging portion capable of attachment to the crossbar by extending partially around one of the plurality of crossbeams and further engages a second one of the plurality of crossbeams, the crossbar engaging portion comprises two leg portions being resiliently flexible and applying oppositely directed resilient forces against the engaged crossbeams for releasably retaining the support hook to the crossbar; the two leg portions each comprising a grasping portion angled outward from the crossbar and from the remaining leg portion.

At least one advantage over the prior art is also provided by a support rack comprising: a crossbar comprising spaced, generally parallel, wall portions, the wall portions being attached to each other by a plurality of crossbeams extending between the wall portions, the crossbeams being spaced along the length of the wall portions; and a plurality of support hooks, each support hook comprises a workpiece engaging portion and a crossbar engaging portion, the crossbar engaging portion is a crossbar hook that is configured to be inserted between two adjacent spaced crossbeams and positioned over top of one of the two adjacent crossbeams and locked in position by placing an end of the crossbar hook generally near the bottom of a third crossbeam.

At least one advantage over the prior art is also provided by an organizer system for a wall, the system comprising: a plurality of crossbars capable of being mounted to a wall, each crossbar comprising spaced, generally parallel, wall portions, the wall portions being attached to each other at least by a plurality of crossbeams extending between the wall portions, the crossbeams being spaced along the length of the wall portions and formed from a pair of opposite, inwardly tapering, frusto-conical projections which are embossed into the legs of the crossbar; a plurality of support hooks, each support hook comprises a workpiece engaging portion and a crossbar engaging portion, the workpiece engaging portions including a variety of configurations for supporting a variety of tools, the crossbar engaging portion being releasably attachable to the crossbar by engaging at least two of the crossbeams; wherein at least one of the crossbar engaging portions of at least one of the plurality of support hooks comprises two leg portions being resiliently flexible and applying oppositely directed resilient forces against the engaged crossbeams for releasably retaining the support hook to the crossbar, the two leg portions each comprising a grasping portion angled outward from the crossbar and from the remaining leg portion.

The support hooks comprise a specialized attachment end that allows the user to attach and remove the support hook from the crossbar by hand quickly and efficiently without the use of special tools. When attached, the support hook can withstand a substantial downward force. The user can change the support hooks as desired in order to space the hooks to efficiently accommodate each particular tool or group of tools, such as when new tools are purchased or replaced or stored during different seasons. The method and apparatus of the present invention further provides a wall organizer system for storing and organizing tools and other objects in home or professional applications, and can be used in garages, utility rooms, shops, retail establishments, residential basements, sheds, etc.

The foregoing and other aspects will become apparent from the following detailed description of the invention when considered with the accompanying drawing figures.

DETAILED DESCRIPTION OF INVENTION

Figure 1:
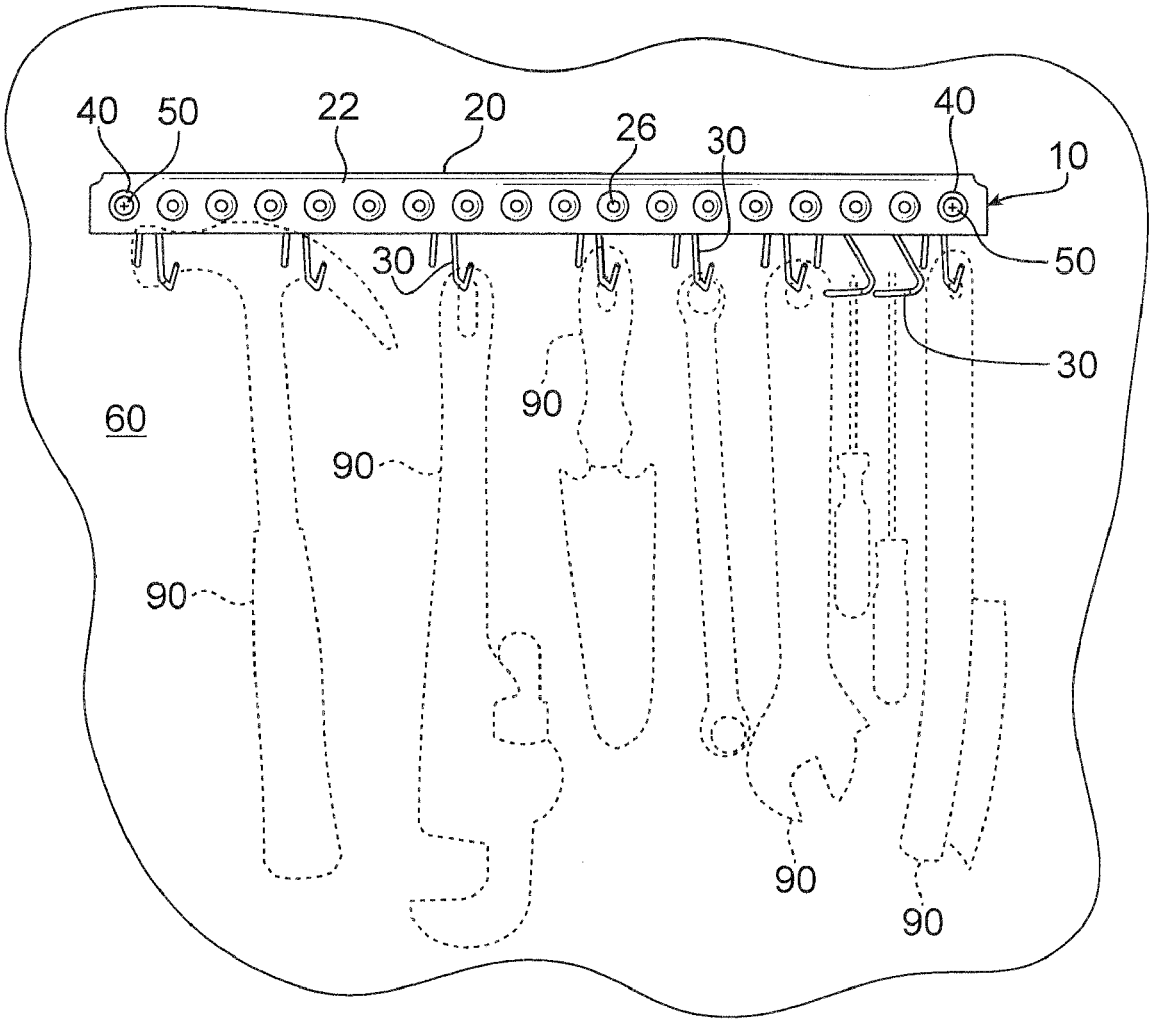
FIG. 1 is a front view of the rack assembly according to an embodiment of the present invention shown attached to a wall and having a plurality of tools hanging therefrom.

Referring now to FIG. 1, an embodiment the rack assembly 10 of present invention is shown supporting a variety of tools 90. While tools 90 are shown, the rack assembly 10 can be used with almost any object or workpiece. The rack assembly 10 comprises a horizontal crossbar 20 and at least one support hook 30. The support hooks 30 are removably attached to the crossbar 20. The support hooks 30 can be configured to hold any number of variations of tools as discussed below.

Figure 2:
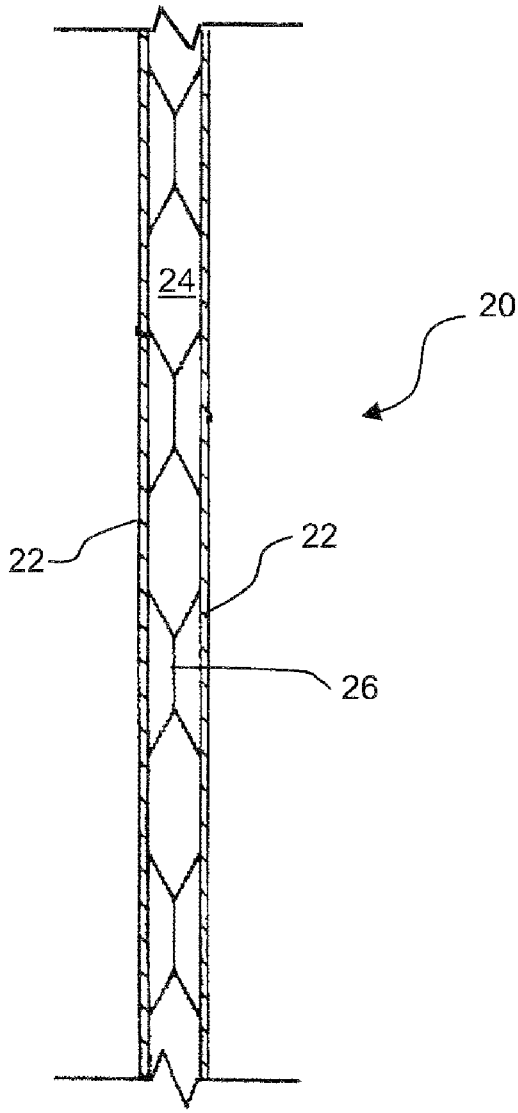
FIG. 2 is a partial bottom view of an embodiment of the crossbar used with the rack assembly of FIG. 1.
Figure 3:
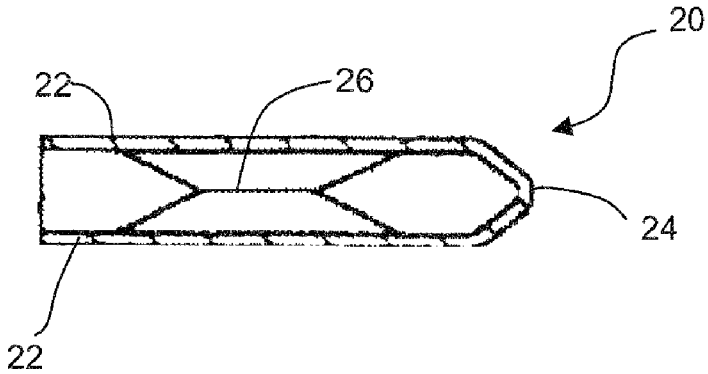
FIG. 3 is an end view of the crossbar of FIG. 2.

As best shown in FIGS. 1-3, the crossbar 20 is a narrow, inverted, U-shaped, channel member. Crossbar 20 includes a pair of spaced walls or legs 22 which are connected by a crossweb 24 at the top of the crossbar 20 and longitudinally along the legs 22. A plurality of crossbeams 26 are connected between the legs 22. These crossbeams 26 are arranged longitudinally along the crossbar 20. The crossbeams 26 are spaced from each other and spaced below the crossweb 24 of the crossbar 20. While the crossbeams 26 could be made of a variety of structures, such as bolts or rods welded in opposite holes, in the embodiment shown, the crossbeams 26 are formed from a pair of opposite, inwardly tapering, frustoconical projections or bosses which are embossed into the legs 22 of the crossbar 20. These bosses or projections are connected together, for example by spot welding or metal stitching, to form an annular beveled groove between the legs 22 of the U-shaped metal crossbar 20.

Figure 4:
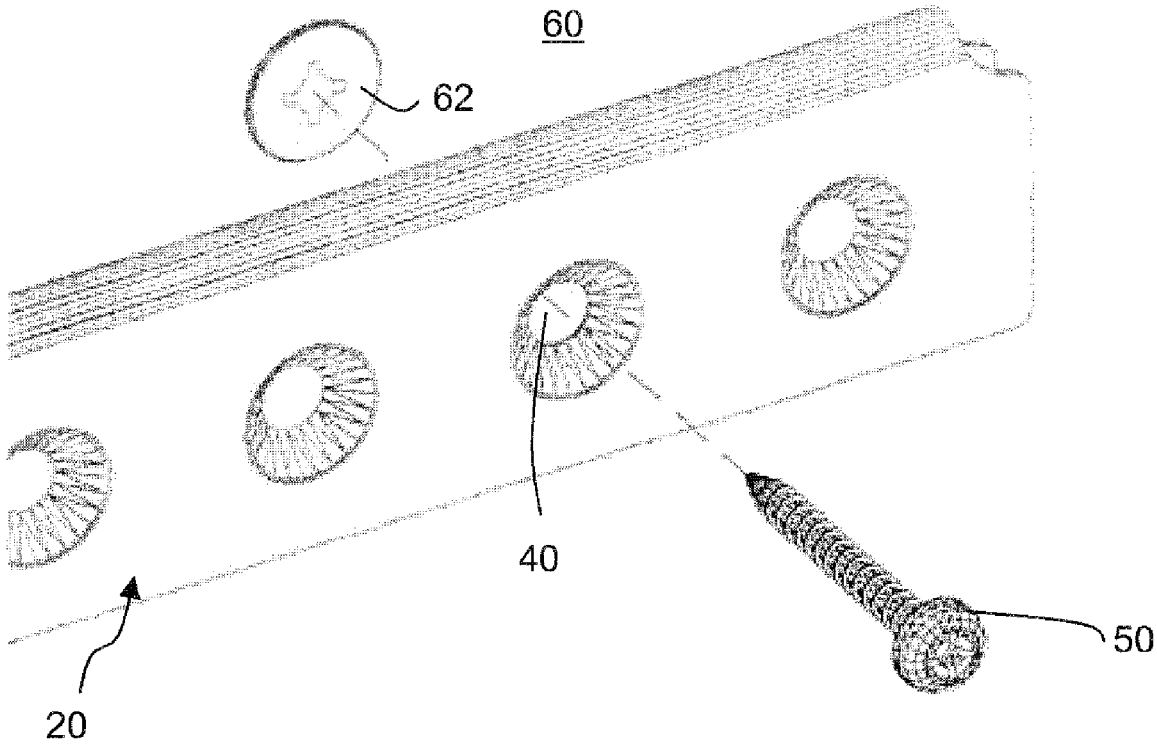
FIG. 4 is an exploded perspective view of the crossbar being attached to a wall.

As shown in FIG. 4, the ends of the horizontal crossbar 20 comprise a means 40 for supporting the crossbar 20 to a wall. In the embodiment shown, the means 40 are presented as apertures through which a fastener 50 is inserted to attach the crossbar 20 to a wall 60. The apertures are typically formed by drilling through one of the crossbeams 26, however the invention is not limited to such a configuration. The fasteners 50 can be mounted to the studs in the wall 60 by using screws, nails, etc., or to the drywall by using an ITW commercial drywall anchor, EZ anchor or any other mounting device 62 designed for securing objects to drywall.

Figure 5:
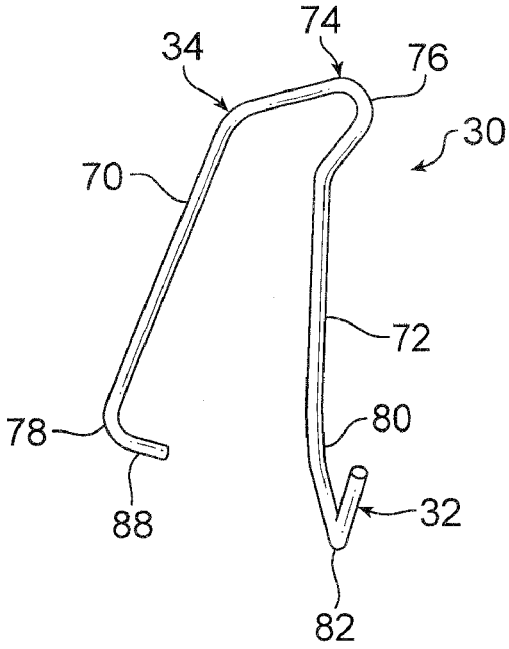
FIG. 5 is a perspective view of an embodiment of a support hook of the present invention.
Figure 6:
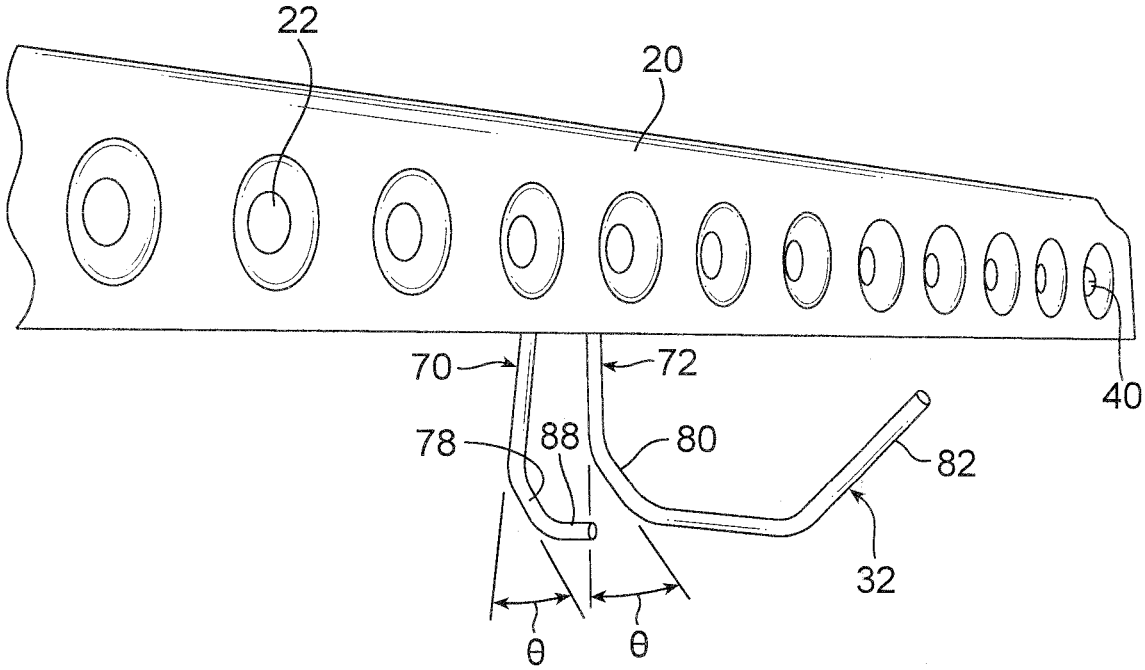
FIG. 6 is a perspective view of an embodiment of a support hook of the present invention showing the grasping portions of the support hook extending away from the wall.
Figure 7:
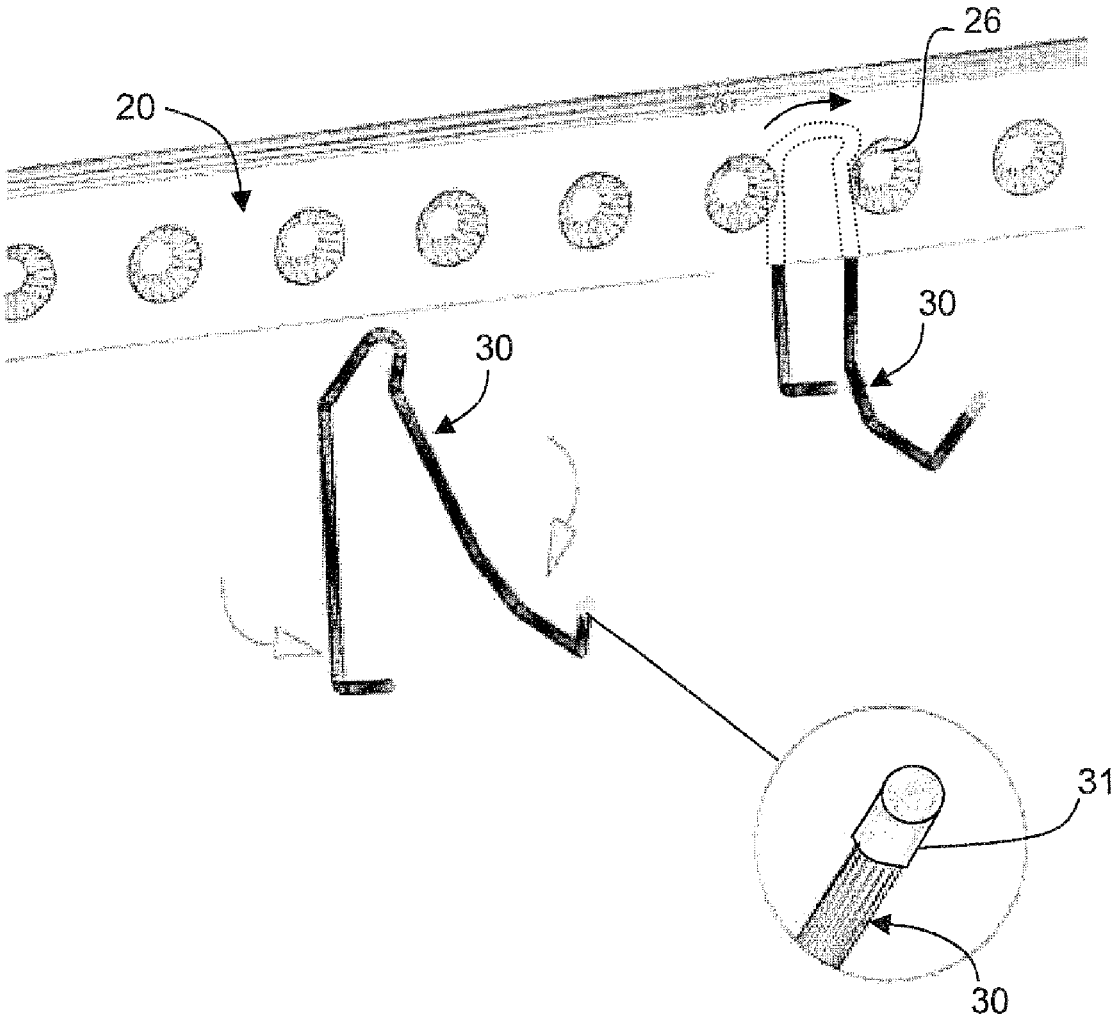
FIG. 7 is a schematic view of the attachment of the support hook of FIG. 5 to the crossbar.

Referring now to FIGS. 5-7 the at least one support hook 30 comprises a workpiece or object engaging portion 32 and a crossbar engaging portion 34. The support hook 30 can be made of resilient, spring-type metal wire such as steel or any other appropriate material including various plastic materials. The support hook 30 can be coated with paint or flexible plastic coating of any desired color. The end of the support hook 30 may have a protective cap 31 constructed out of material such as rubber, plastic, etc.

The top section of the support hook 30 is the crossbar engaging portion 34. The crossbar engaging portion 34 comprises two leg portions 70, 72 extending from a top portion 74. The crossbar engaging portion 34 further comprises a locking portion 76 between the top portion 74 and one of the leg portions 72. The crossbar engaging portion 34 of the support hook 30 is attached to the crossbar 20 by squeezing the two leg portions 70, 72 together and inserting the top portion 74 between two adjacent spaced crossbeams 26 of crossbar 20. The crossbar engaging portion 34 is positioned at an angle such that the locking portion 76 is positioned between the two adjacent crossbeams 26 when the crossbar engaging portion 34 is initially inserted into the crossbar 20. The crossbar engaging portion 34 is then locked to the crossbar 20 by rotating the support hook 30 clockwise such that the locking portion 76 rotates generally above one groove of the two adjacent spaced annular beveled grooves of the horizontal crossbar 20 until the leg portion 70 engages the other crossbeam 26 of the two adjacent crossbeams 26. Once locked in place, the support hook 30 is not removable by a downward force, allowing the support hook 30 to support a significant weight without requiring the support hook 30 to be permanently attached to the crossbar 20 or requiring tools for the attachment of the support hook 30 to the crossbar 20.

To remove the support hook 30 from the crossbar 20, the steps are the reverse of the assembly. The two legs 70, 72 are squeezed together, thus disengaging leg 70 from the groove. The support hook 30 is then rotated counter-clockwise until the locking portion 76 is rotated such that it is no longer above the groove. The support hook 30 is then removed from the open bottom end of the channel of crossbar 20. It is noted that leg 70 and leg 72 comprise a grasping portion 78, 80, respectively, that extends at an angle θ from remainder of the legs 70, 72 in a direction away from the wall 60 which allows the user clearance to grasp and squeeze the legs 70, 72 when inserting and removing the support hook 30 from the crossbar 20 mounted to wall 60. The grasping portion 78 of leg 70 may also include a portion 88 bent toward the opposite leg 72. This bent portion 88 can prevent possible injury to the user or may be used to limit the distance that the legs 70, 72 can be squeezed together.

The workpiece or object engaging portion 32 of the support hook 30 extends from the grasping portion 80 of the crossbar engaging portion 34 of the crossbar 20. The workpiece or object engaging portion 32 is customarily bent into a hook-shaped end 82, but also may be in any other configuration suitable for engaging and supporting particular workpieces or tools 90. The term hook is utilized, however, to include the great variety of configurations which may be devised for engaging workpieces. This portion of the wire can be custom designed to accommodate particular shapes of various workpieces or tools 90. It may, for example, extend laterally off the rack assembly 10 or it may extend outwardly to hold the workpieces or tools 90 out and away from the rack assembly 10.

Figure 8:
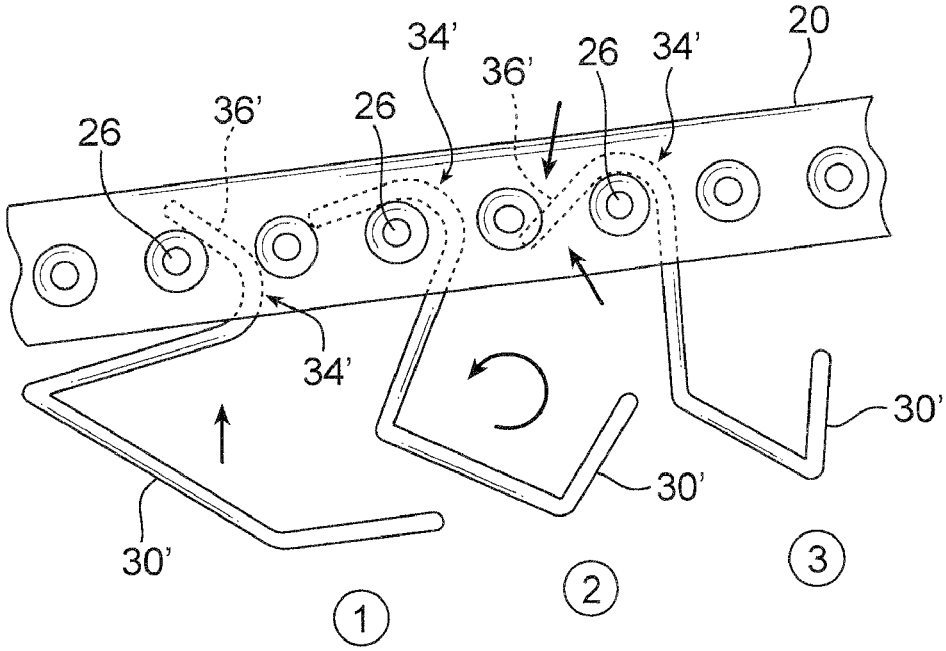
FIG. 8 is a schematic view of the attachment steps of a second embodiment of a support hook to the crossbar.

Referring now to FIG. 8, an embodiment of the rack assembly 10' is shown using support hook 30' of an alternate configuration being attached to a crossbar 20 in a series of progressive steps. The crossbar engaging portion 34' of the support hook 30' is an engaging hook 36' that is configured to be positioned between two adjacent crossbeams 26 wherein the engaging hook 36' is positioned over top of one of the crossbeams 26 by rotating the support hook 30' and then is locked in position by placing the end of the engaging hook 36' underneath a third crossbeam 26. These support hooks 30' provide more holding capability and are generally used in heavy duty applications.

The rack assembly 10 of the present invention can provide an alternate way of storing tools used in home or garden applications. Typically, tools are stored in tool drawers, chests, or bins. This invention proposes a way to hang tools which can utilize space and provide easier access to tools. The disadvantage of the traditional system of storing tools is that tools stored in bins may be damaged or lost. Searching for tools in tool drawers or chests takes time, and the rack system can store the tools neatly and efficiently to save time, money, and space. The rack system in this invention provides an improvement over the prior and current methods of storing tools around the shop, home, garage, etc.

Figure 9:
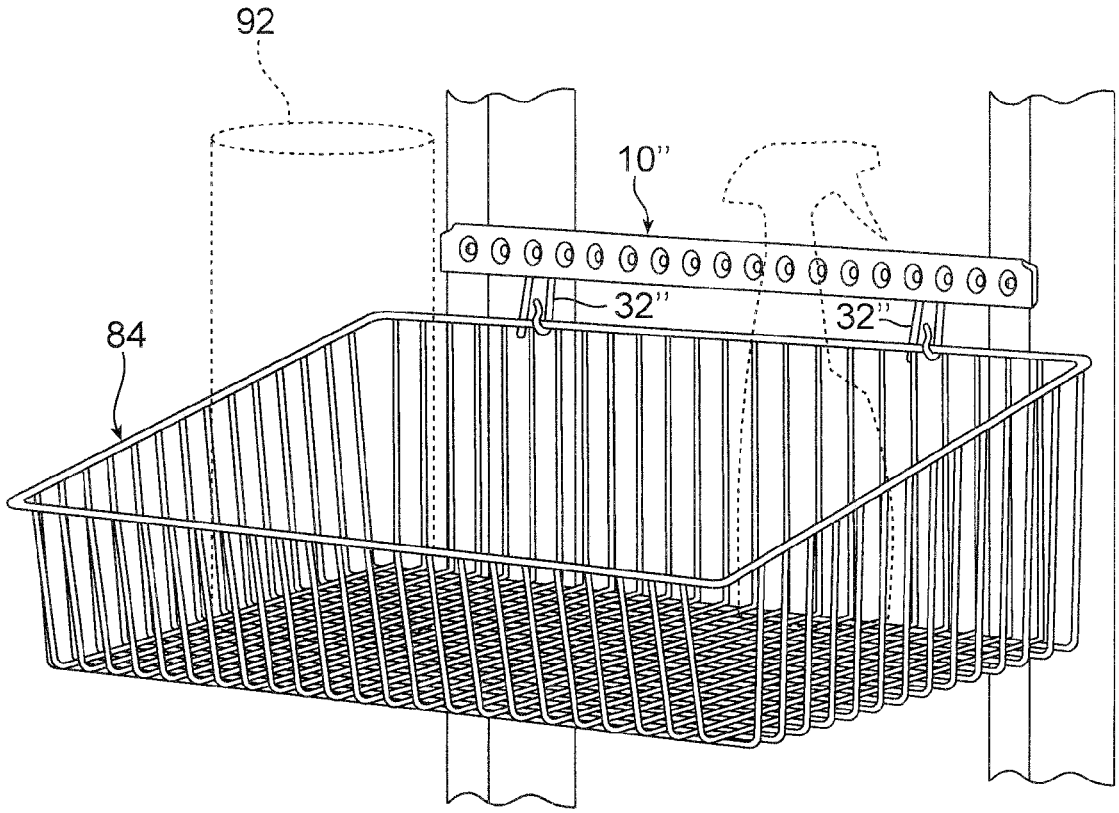
FIG. 9 is an embodiment showing the rack assembly including a basket.

In another embodiment of the invention as shown in FIG. 9, the rack assembly 10" comprises a basket 84. The support hooks 30" are designed to support a basket 84 in which a variety of objects 92 can be placed which may not be suitable for hanging on a hook. It is contemplated that the basket 84 can be of any size and is not limited by the length of the crossbar 20 (the basket could be supported by two or more crossbars).

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A support rack comprising:

a crossbar comprising (i) spaced, generally parallel, wall portions, the wall portions being attached to each other at least by a plurality of crossbeams extending between the wall portions, the crossbeams being longitudinally arranged and spaced along the length of the wall portions, wherein the crossbeams are formed from a pair of opposite, inwardly tapering, frusto-conical projections which are embossed into the legs of the crossbar, and (ii) a plurality of apertures for attachment of the crossbar to a wall by a plurality of fasteners, the apertures being selected crossbeams; and a plurality of support hooks, each support hook comprises a workpiece engaging portion and a crossbar engaging portion;

the crossbar engaging portion capable of attachment to the crossbar by extending partially around one of the plurality of crossbeams and further engages a second one of the plurality of crossbeams, the crossbar engaging portion comprises two leg portions being resiliently flexible and applying oppositely directed resilient forces against the engaged crossbeams for releasably retaining the support hook to the crossbar;

the two leg portions each comprising a grasping portion angled outward from the wall portion and from the remaining leg portion, and wherein one of the leg portions comprises a portion extending generally toward the other of the two leg portions.

2. The support rack of claim 1, wherein the walls are connected by a crossweb extending longitudinally along substantially the length of the crossbar.

3. The support rack of claim 1, wherein the workpiece engaging portion is in the form of a hook.

4. The support rack of claim 1, wherein the projections are connected together by welding to form an annular beveled groove between the legs of the crossbar.

5. The support rack of claim 1, wherein the plurality of apertures includes apertures located along the length of the crossbar.

6. The support rack of claim 1 further comprising a basket.

7. The support rack of claim 1 wherein the plurality of support hooks include a plurality of workpiece engaging configurations.

8. The support rack of claim 1 wherein the plurality of support hooks are made of steel.

9. The support rack of claim 1 wherein the plurality of support hooks include at least two different gauges of steel.

10. The support rack of claim 1 further comprising at least one support hook having a crossbar engaging portion capable of attachment to the crossbar by extending upward from a bottom of the crossbar and around the top of one of the plurality of crossbeams and further extending to engage an adjacent crossbeam underneath the crossbeam.

11. A support rack comprising:

a crossbar comprising spaced, generally parallel, wall portions, the wall portions being attached to each other by a plurality of crossbeams extending between the wall portions, the crossbeams being longitudinally arranged and spaced along the length of the wall portions, wherein the crossbeams are formed from a pair of opposite, inwardly tapering, frusto-conical projections which are embossed into the legs of the crossbar; and a plurality of support hooks, each support hook comprises a workpiece engaging portion and a crossbar engaging portion, the crossbar engaging portion is a crossbar hook that is configured to be inserted between two adjacent longitudinally arranged spaced crossbeams and positioned over top of one of the two adjacent crossbeams and locked in position by placing an end of the crossbar hook underneath a third crossbeam.

12. The support rack of claim 11, wherein the walls are connected by a crossweb extending longitudinally along substantially the length of the crossbar.

13. The support rack of claim 11, wherein the workpiece engaging portion is in the form of a hook.

14. The support rack of claim 11, wherein the projections are connected together by welding to form an annular beveled groove between the legs of the crossbar.

15. The support rack of claim 11, wherein the plurality of support hooks include a plurality of workpiece engaging configurations.

16. The support rack of claim 11, wherein the plurality of support hooks are made of steel.

17. An organizer system for a wall, the system comprising:

a plurality of crossbars capable of being mounted to a wall, each crossbar comprising (i) spaced, generally parallel, wall portions, the wall portions being attached to each other at least by a plurality of crossbeams extending between the wall portions, the crossbeams being longitudinally arranged and spaced along the length of the wall portions and formed from a pair of opposite, inwardly tapering, frusto-conical projections which are embossed into the legs of the crossbar, and (ii) a plurality of apertures for attachment of the crossbar to a wall by a plurality of fasteners, the apertures being selected crossbeams;

a plurality of support hooks, each support hook comprises a workpiece engaging portion and a crossbar engaging portion, the workpiece engaging portions including a variety of configurations for supporting a variety of tools, the crossbar engaging portion being releasably attachable to the crossbar by engaging at least two of the crossbeams;

wherein at least one of the crossbar engaging portions of at least one of the plurality of support hooks comprises two leg portions being resiliently flexible and applying oppositely directed resilient forces against the engaged crossbeams for releasably retaining the support hook to the crossbar, the two leg portions each comprising a grasping portion angled outward from the wall portion and from the remaining leg portion, and wherein one of the leg portions comprises a portion extending generally toward the other of the two leg portions.

* * * * *